US007464544B2

(12) United States Patent
Kono et al.

(10) Patent No.: US 7,464,544 B2
(45) Date of Patent: Dec. 16, 2008

(54) PRESSURE DEVICE

(75) Inventors: Kazutoshi Kono, Tokyo (JP); Ryozo Ariizumi, Tokyo (JP)

(73) Assignee: Koganei Corporation, Tokyo (JP)

( * ) Notice: Subject to any disclaimer, the term of this patent is extended or adjusted under 35 U.S.C. 154(b) by 479 days.

(21) Appl. No.: 10/552,404

(22) PCT Filed: Apr. 9, 2004

(86) PCT No.: PCT/JP2004/005123

§ 371 (c)(1),
(2), (4) Date: Oct. 7, 2005

(87) PCT Pub. No.: WO2004/092592

PCT Pub. Date: Oct. 28, 2004

(65) Prior Publication Data

US 2006/0180038 A1 Aug. 17, 2006

(30) Foreign Application Priority Data

Apr. 11, 2003 (JP) ..... 2003-107424

(51) Int. Cl.
*F16D 31/02* (2006.01)
*F01B 19/02* (2006.01)

(52) U.S. Cl. ..... 60/372; 92/64; 92/97

(58) Field of Classification Search ..... 92/50, 92/64, 97; 60/372
See application file for complete search history.

(56) References Cited

U.S. PATENT DOCUMENTS 3,986,355 A * 10/1976 Klaeger ..... 60/372
4,347,049 A * 8/1982 Anderson ..... 60/372
4,406,122 A * 9/1983 McDuffie ..... 60/372
6,116,025 A * 9/2000 Tucker ..... 60/372

FOREIGN PATENT DOCUMENTS

| | | |
|---|---|---|
| JP | 57-83904 | 11/1955 |
| JP | 59-93502 | 5/1984 |
| JP | 2002-1587 | 1/2002 |
| JP | 2002-11595 | 1/2002 |
| JP | 2002-21811 | 1/2002 |
| JP | 2002-174204 | 6/2002 |

OTHER PUBLICATIONS

Kenji Araki, Naike Chen & Tatsuhiko Uedani, Characteristics of the Pneumatic Circuit of a Diaphragm Type Pneumatic Pressure Control Valve, 5th Joint Symposium on Fluid Control and Measurement, Tokyo, 1995, 6 pages.

* cited by examiner

*Primary Examiner*—Michael Leslie
(74) *Attorney, Agent, or Firm*—McCormick, Paulding & Huber LLP

(57) ABSTRACT

A reciprocating body 12 is reciprocably housed in a cylinder body 6, and a pressure rod 20 is reciprocably attached to this reciprocating body 12. A pressure end 20*a* of the pressure rod 20 protrudes from the cylinder body 12 toward the outside. By the reciprocating body 12 and diaphragms 17 to 19, an advance pressure chamber 27 and a weight offset pressure chamber 29 are partitioned and formed in the cylinder body 6. After the pressure end 20*a* is disposed vertically downwardly, the weight offset pressure chamber 29 is filled with compressed fluid, whereby self weight of the reciprocating body 12 and the pressure rod 20 is offset. Then, the compressed fluid is supplied to the advance pressure chamber 27, and an object to be pressurized W is pressurized through the pressure rod 20.

6 Claims, 5 Drawing Sheets

PRESSURE DEVICE

CROSS REFERENCE TO RELATED APPLICATIONS

This application claims the benefit of PG Application No. PCT/JP2004/005123, filed on Apr. 9, 2004 and Japanese Patent Application No. 2003-107424, filed Apr. 11, 2003, the disclosures of which are herein incorporated by reference in their entirety.

TECHNICAL FIELD

The present invention relates to a pressure device for linearly reciprocating a pressure rod by fluid pressure such as compressed air.

BACKGROUND OF THE INVENTION

Devices for applying pressure to an object to be pressurized via a pressure rod include a device that carries out pressurization by converting fluid energy such as compressed air into linear motion of the pressure rod. Generally, such a pressure device is called a fluid pressure cylinder. The basic structure thereof comprises a cylinder tube in which a piston is housed to be reciprocable axially, end covers provided at both ends of the cylinder tube, and a pressure rod protruding from an end of a cylinder body formed by the cylinder tube and the end covers. The pressure rod is attached to the piston, and when fluid pressure is supplied to a pressure chamber formed in the cylinder body, the piston and the pressure rod are driven axially.

Among fluid pressure cylinders, a fluid pressure cylinder of a type in which pressure chambers are formed on both sides of the piston and advance movement and retraction movement of the pressure rod are performed by fluid pressure is called a double acting type, and the type in which one of the advance movement and the retraction movement is carried out by the fluid pressure and the other is carried out by an external force such as a spring force is called a single acting type. There are the cases where compressed air is used as the fluid energy for driving the piston, and where liquid such as working oil is used. In order to ensure airtightness between an outer circumferential surface of the piston and an inner circumferential surface of the cylinder tube, a sealing member such as an O ring or a packing is attached to an outer circumference of the piston.

In such a fluid pressure cylinder, when the piston and the pressure rod are reciprocated in a vertical direction or an inclined direction to apply pressure to an object, weight of the piston and the pressure rod acts on the object. Moreover, along with the reciprocation of the piston and the pressure rod, sliding friction is caused between the sealing member attached for enhancing the airtightness and the inner circumferential surface of the cylinder tube. When the object to be pressurized is intended to be subjected to a predetermined pressure thrust, the gravity and the friction resistance force working on the piston and the pressure rod become disturbance with respect to a target value and make it difficult to control the pressure thrust. Particularly, in a pneumatic cylinder operated by lower pressure than that in a hydraulic cylinder, an influence of the friction resistance of the sealing member becomes relatively large and, as a result, it becomes difficult to control the pressure thrust with high accuracy.

In order to achieve high accuracy of the manufacture products at, for example, production sites of precision apparatuses, a dust-free room (clean room), in which particles and aerosols floating in air are controlled at predetermined values or less, is used sometimes. If a conventional fluid pressure cylinder is used in the dust-free room, the sliding friction is generated and further a portion of the sealing member, which is in slidable contact with the piston or pressure rod, is peeled and floats, thereby becoming cause of dust, so that it is difficult to make management of the dust-free room.

An object of the present invention is to provide a pressure device capable of controlling the pressure thrust with high accuracy.

Another object of the present invention is to provide a pressure device for preventing dust generated in the device from being dispersed to the outside.

SUMMARY OF THE INVENTION

A pressure device according to the present invention is one attached to an actuator and applying pressure to an object to be pressurized and comprises: a cylinder body, to one end of which an attachment of said actuator is attached and to the other end of which a through hole communicating with a housing chamber formed therein is provided; a pressure rod axially reciprocably attached to said cylinder body and provided, at one end of the pressure rod, with a pressure end protruding from said through hole; a reciprocating body provided at the other end of said pressure rod and having a diameter smaller than that of an inner circumferential surface of said housing chamber, which is reciprocably housed in said housing chamber; and an advance pressure diaphragm provided between said reciprocating body and said cylinder body and partitioning and forming an advance pressure chamber for applying a pressure thrust toward said object to be pressurized.

The pressure device according to the present invention comprises a weight offset pressure diaphragm provided between said reciprocating body and said cylinder body, and partitioning and forming a weight offset pressure chamber for applying a weight offset thrust in a direction opposite to said pressure thrust.

The pressure device according to the present invention comprises an offset load adjusting diaphragm provided between said reciprocating body and said cylinder body, partitioning and forming said weight offset pressure chamber along with said weight offset pressure diaphragm, and blocking off the weight offset pressure chamber and an ambient-air pressure chamber.

The pressure device according to the present invention is such that said reciprocating body and said pressure rod are disposed so that said pressure rod is directed vertically downwardly, and said weight offset pressure chamber is filled with compressed fluid that is set at fluid pressure capable of retaining said reciprocating body in a state in which said reciprocating body is out of contact with any of inner wall surfaces of said cylinder body.

The pressure device according to the present invention is such that a dust collecting port is formed in said cylinder body.

The pressure device according to the present invention is such that said pressure rod is out of contact with said through hole.

According to the present invention, since the weight offset pressure chamber partitioned and formed by the weight offset pressure diaphragm is filled with compressed fluid, it is possible to apply a weight offset thrust and offset the self weight of the reciprocating body and the pressure rod. In addition thereto, by supplying the predetermined compressed fluid to the advance pressure chamber, the pressure thrust can be controlled with high accuracy.

When pressure is applied horizontally to the object to be pressurized, the predetermined pressure thrust can be applied to the object to be pressurized by not forming the weight offset pressure chamber but supplying the compressed fluid to the advance pressure chamber.

Since the respective pressure chambers are partitioned and formed by using rolling diaphragms, an occurrence of sliding friction due to reciprocation of the reciprocating body can be suppressed.

An advance port communicating with the advance pressure chamber and a weight offset port communicating with the weight offset pressure chamber are provided in separated systems, so that the pressure thrust and the weight offset thrust can be independently set.

When the rolling diaphragm is used, the following features can be further utilized. That is, hysteresis loss is remarkably small and life of the diaphragm is long since the folded portion rolls; the effective pressure-receiving area is kept constant throughout the entire stroke; the pressure device can be designed for minute pressure (water column: 25 mm) to high pressure (100 kg/cm$^2$) since the folded portion is narrow; calculation of the pressure thrust can be simplified since there is no spring rigidity; no particular attention has to be paid to surface finishing, a material, and hardness, etc. of the reciprocating body or cylinder since the diaphragm rolls; and there is an automatic centripetal effect even when slight eccentricity or declination is caused in the reciprocating body (when the reciprocating body is moved to one side, a restoring force acts thereon and the reciprocating body is returned to a central line).

Since the dust collecting port is provided to the cylinder body, the dust generated in the cylinder body due to the sliding motion can be prevented from being dispersed to the outside.

The pressure device can be attached to various actuators regardless of a moving method, a moving distance, and a moving direction. Since an object of the actuator is to move the pressure device to a predetermined position, an occurrence of sliding fiction is also permissible, so that a general-purpose actuator using a sealing member can be utilized, which results in the reduction of costs.

Since the pressure device is moved by the actuator, the stroke of the reciprocating body provided in the pressure device can be set short, whereby the life of the diaphragm is extended.

An object of the pressure device is to apply pressure to the object to be pressurized, and it is not required to provide the spring for return, whereby the number of parts can be reduced.

Various attachments can be attached to the pressure rod, whereby a wide range of use may be found within the scope of not departing from the gist of the present invention.

DESCRIPTION OF THE PREFERRED EMBODIMENTS

Hereinafter, embodiments of the present invention will be detailed based on the drawings.

Figure 1A:
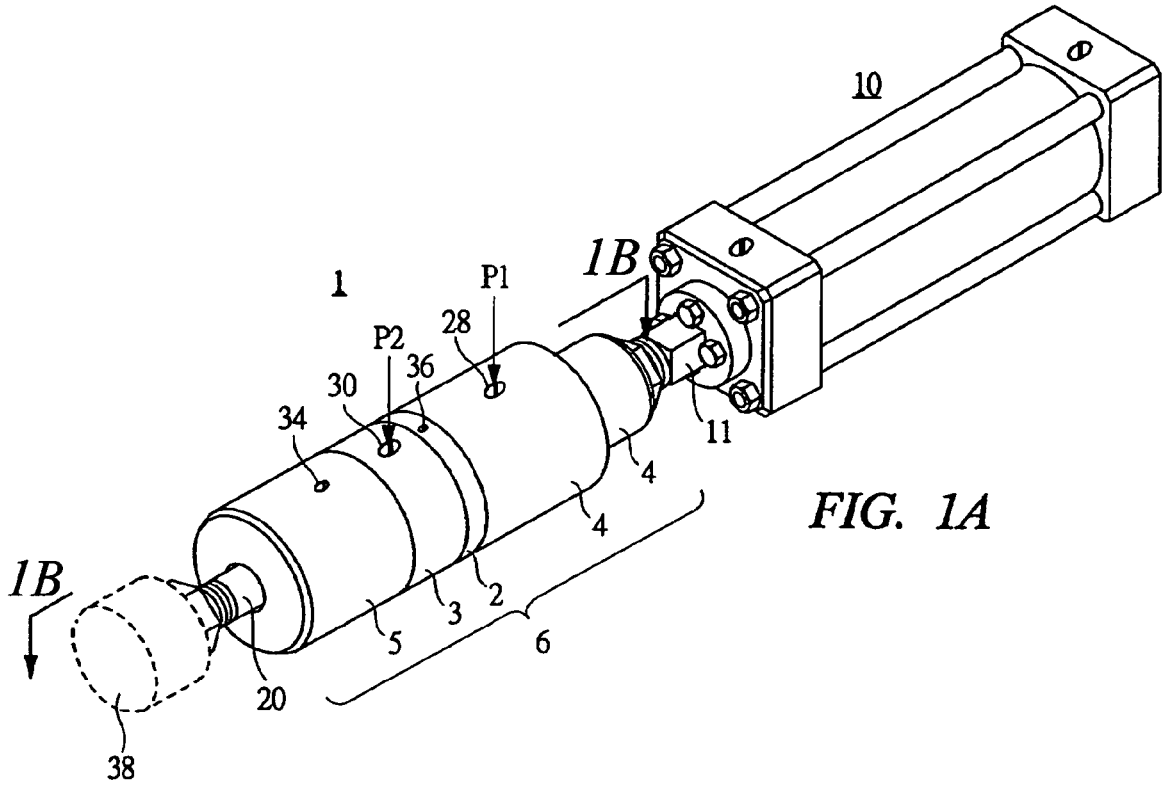
FIG. 1A is a perspective view showing a state in which a pressure device that is a first embodiment of the present invention is attached to a fluid pressure cylinder.
Figure 1B:
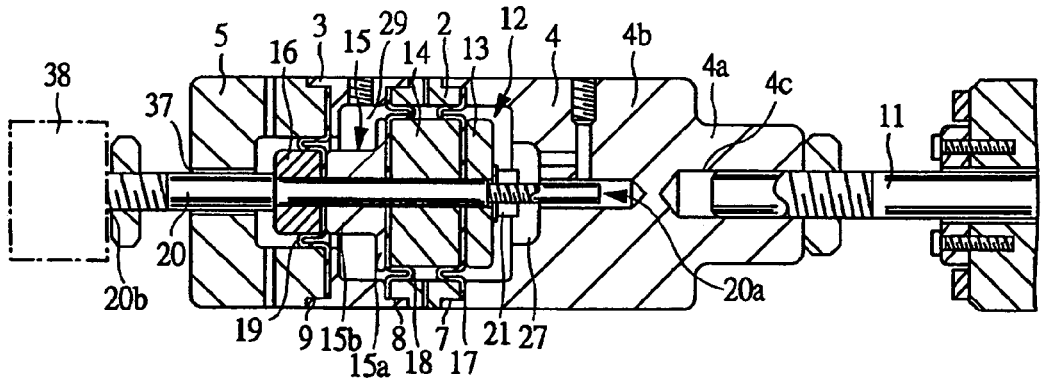
FIG. 1B is a vertical cross-sectional view in a direction along the line 1B-1B in FIG. 1A.

FIG. 1A is a perspective view showing a state in which a pressure device that is a first embodiment of the present invention is attached to a fluid pressure cylinder. FIG. 1B is a vertical cross-sectional view in a direction along the line 1B-1B in FIG. 1A. In this pressure device 1, compressed air is used as working fluid, and a cylinder assembly, i.e., a cylinder body 6 is constituted by two cylinder rings 2 and 3, an end cover 4 serving as a head cover provided at one end, and an end cover 5 serving as a rod cover provided at the other end. In order to form the cylinder body 6, screw coupling portions 7 to 9 are respectively formed on outer circumferential surfaces of the cylinder rings 2 and 3 and inner circumferential surfaces of the end covers 4 and 5. Note that the cylinder rings 2 and 3 and the end covers 4 and 5 may be respectively coupled by caulking or coupled by use of screw members instead of being screw-coupled.

In the case shown in FIG. 1B, although an actuator attaching portion 4*a* and a pressure-chamber forming portion 4*b* of the end cover 4 are integrated, these may be assembled as separate members by a connection means such as screw connection. Although the cylinder rings 2 and 3 are formed by cylindrical members whose thicknesses are entirely uniform in a circumferential direction, the cylinder rings 2 and 3 may be formed by quadrangular prism members.

An actuator attaching hole 4*c* in which a screw coupling portion is provided is formed in the attaching portion 4*a* of the end cover 4, and a piston rod 11 of a fluid pressure cylinder 10 serving as an actuator is attached into the attaching hole 4*c*. When an unshown piston incorporated in the fluid pressure cylinder 10 is reciprocated, the pressure device 1 is linearly reciprocated within a range of a predetermined stroke. Note that as the actuator for moving the pressure device 1, various actuators may be employed, that is, a hydraulic/pneumatic actuator or an electric actuator may be employed or an actuator for performing any of linear motion, swing motion, and rotary motion may be employed. The illustrated piston rod 11 is a so-called square rod. However, instead of that, a pressure rod with a circular cross section may be employed or a rodless cylinder may be employed.

A cylindrical housing chamber is formed at an interior of the cylinder body 6 and, in the interior of the housing chamber, a reciprocating body 12 with a diameter smaller than that of an inner circumferential surface of the housing chamber is housed so as to be reciprocable axially. The reciprocating body 12 comprises a disk-like advance pressure-receiving member 13, a rod collar 14, a weight offset pressure-receiving member 15, and an advance-limit restriction member 16, at each center portion of which an unshown pressure rod through-hole is formed. In addition, an advance pressure diaphragm 17 is sandwiched between the advance pressure-receiving member 13 and the rod collar 14, a weight offset pressure diaphragm 18 is sandwiched between the rod collar 14 and the weight offset pressure-receiving member 15, and an offset load adjusting diaphragm 19 is sandwiched between the weight offset pressure-receiving member 15 and the advance-limit restriction member 16. As the diaphragms 17 to 19, bellofram type diaphragms in each of which a pressure rod through-hole is formed at a center portion thereof are employed.

The diaphragm is a cylindrical thin-film part that has a long stroke and a deep folded portion and in which an effective pressure-receiving area thereof is kept constant during actuation, wherein an actuated film portion is designed to be extremely thin and has a structure coated with rubber on a strong polyester cloth etc. Since a plurality of pressure chambers are partitioned and formed, the folded portion is provided between the reciprocating body 12 and the cylinder and used, so that when different pressures are supplied to the pressure chambers, the folded portion is elastically deformed and thereby pressure differential can be converted into positional displacement. Particularly, the bellofram type diaphragm is also called as a rolling diaphragm, and has a feature capable of being used with no lubrication and without being slid by rolling the folded portion provided in a gap between the reciprocating body and the cylinder.

An outer diameter of the advance pressure-receiving member 13 is equal to that of the rod collar 14, and an outer diameter of the advance-limit restriction member 16 is smaller than that of the advance pressure-receiving member 13. An outer diameter of the weight offset pressure-receiving member 15 changes stepwise, and comprises a large-diameter portion 15*a* disposed on a side of a rod collar 14 and having a diameter equal to that of the rod collar 14, and a small-diameter portion 15*b* disposed on a side of the advance-limit restriction member 16 and having a diameter equal to that of the advance-limit restriction member 16. In order that the advance pressure-receiving member 13 is disposed on a side of a base end 20*a* of the pressure rod 20 and the advance-limit restriction member 16 is disposed on a side of a pressure end 20*b* of the pressure rod 20, these members are sequentially inserted from the side of the base end 20*a* having a diameter smaller than that of the pressure end 20*b* and fastened by a nut 21.

Figure 2:
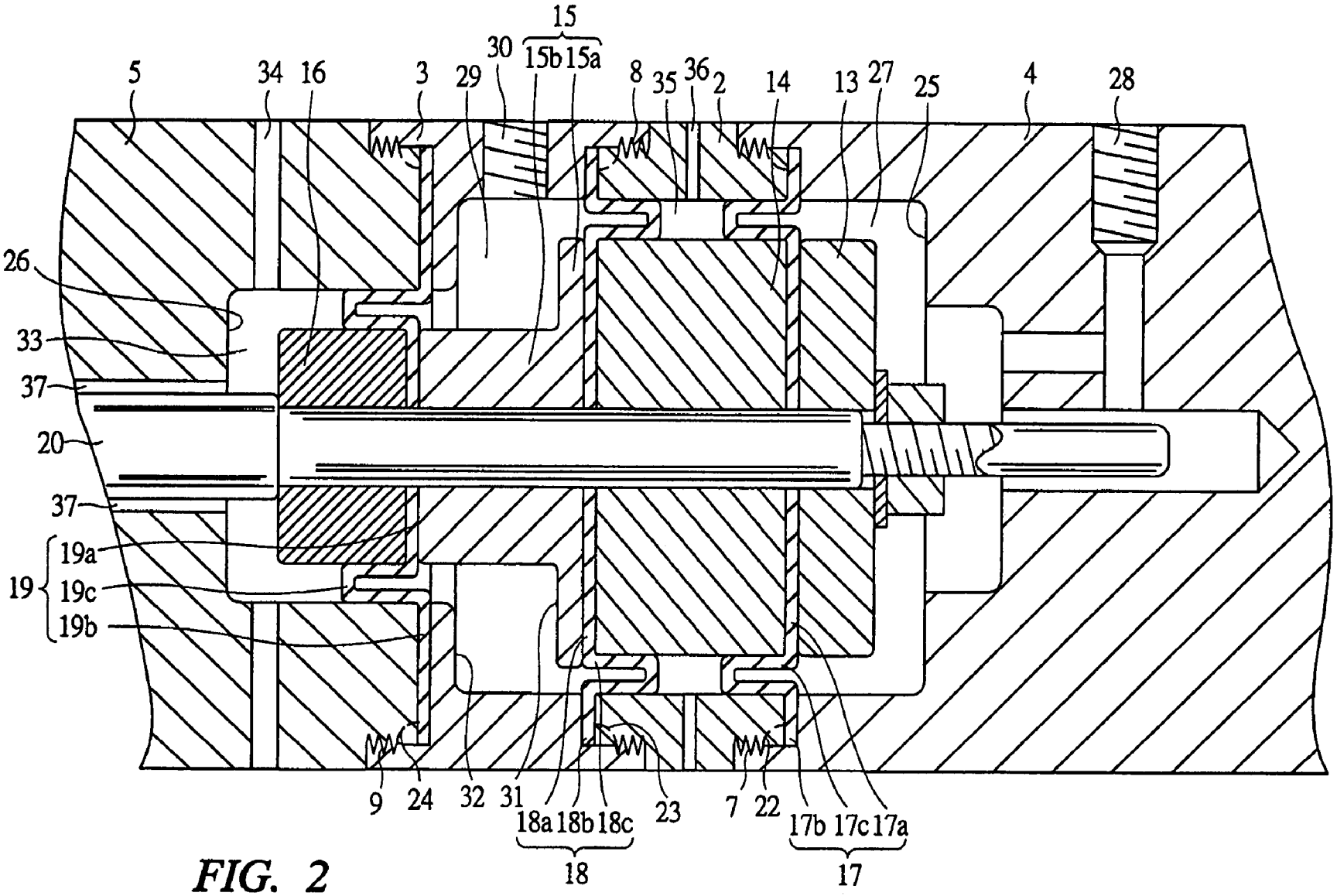
FIG. 2 is a vertical cross sectional view enlarging and showing a portion of FIG. 1.

FIG. 2 is a vertical cross-sectional view enlarging and showing a portion of FIG. 1. The advance pressure diaphragm 17 has a central portion 17*a* sandwiched between the advance pressure-receiving member 13 and the rod collar 14, a flange portion 17*b* sandwiched between the cylinder ring 2 and the end cover 4, and a cylindrical portion 17*c* disposed between the inner circumferential surface of the cylinder ring 2 and the outer circumferential surface of the rod collar 14 and having an inner/outer double structure via the folded portion. The weight offset pressure diaphragm 18 has a central portion 18*a* sandwiched between the rod collar 14 and the weight offset pressure-receiving member 15, a flange portion 18*b* sandwiched between the cylinder ring 2 and the cylinder ring 3, and a cylindrical portion 18*c* disposed between the inner circumferential surface of the cylinder ring 2 and the outer circumferential surface of the rod collar 14 and having an inner/outer double structure via the folded portion. The offset load adjusting diaphragm 19 has a central portion 19*a* sandwiched between the weight offset pressure-receiving member 15 and the advance-limit restriction member 16, a flange portion 19*b* sandwiched between the cylinder ring 3 and the end cover 5, and a cylindrical portion 19*c* disposed between the inner circumferential surface of the end cover 5 and the outer circumferential surface of the advance-limit restriction member 16 and having an inner/outer double structure via the folded portion.

The folded portions of the cylindrical portions 17*c* and 19*c* are provided on the side of the pressure end 20*b* and the folded portion of the cylindrical portion 18*c* is provided on the side of the base end 20*a*, so that even when compressed fluid is supplied to interiors of the pressure chambers, the folded portions are not reversed and entangled. Note that the respective diaphragms 17 to 19 can also be more firmly sandwiched by, as shown by broken lines in FIG. 2, forming annular grooves in the end cover 5 and the cylinder ring 2 and concurrently providing beads 22 to 24, which are to be engaged with the annular grooves, to the flange portions 17*b*, 18*b*, and 19*b*.

A stopper surface 25 for restricting a retraction-directional stroke of the reciprocating body 12 is formed on the end cover 4, and a stopper surface 26 for restricting an advance-directional stroke of the reciprocating body 12 is formed on the end cover 5. When the reciprocating body 12 reciprocates within a range of those strokes, the folded portions of the respective diaphragms 17 to 19 smoothly roll, whereby a constant effective pressure-receiving area is maintained and no sliding resistance is generated and further consideration to a change in repulsive forces is not required since spring rigidity is also constant, so that simplification of calculation of the pressure thrust can be achieved.

In the interior of the cylinder body 6, an advance pressure chamber 27 is partitioned and formed by the end cover 4, the cylinder ring 2, the advance pressure-receiving member 13, and the advance pressure diaphragm 17. An advance supply/exhaust port 28 communicating with the advance pressure chamber 27 is formed in the end cover 4, so that an advance-directional pressure thrust acts on the reciprocating body 12 in accordance with the amplitude of fluid pressure P1 supplied to the advance pressure chamber 27 via the advance supply/exhaust port 28.

In addition, in the interior of the cylinder body 6, a weight offset pressure chamber 29 is partitioned and formed by the cylinder ring 3, the weight offset pressure-receiving member 15, the weight offset pressure diaphragm 18, and the offset load adjusting diaphragm 19. A weight offset supply/exhaust port 30 communicating with the weight offset pressure chamber 29 is formed in the cylinder ring 3, so that a retraction-directional weight offset thrust acts on the reciprocating body 12 in accordance with the amplitude of fluid pressure P2 supplied to the weight offset pressure chamber 29 via the weight offset supply/exhaust port 30.

Furthermore, in the interior of the cylinder body 6, an ambient-air pressure chamber 33 is partitioned and formed by the end cover 5, the advance-limit restriction member 16, and the offset load adjusting diaphragm 19, and an ambient-air pressure port 34 communicating with the ambient-air pressure chamber 33 is formed in the end cover 5. The ambient-air pressure port 34 is a so-called ventilation hole which can improve a pressure response of the reciprocating body 12. Similarly thereto, a ventilation hole 36 is also formed for a space 35 partitioned and formed by the advance pressure diaphragm 17 and the weight offset pressure diaphragm 18. Note that since unshown air-intake nozzles are attached to the ambient-air pressure port 34 and the ventilation hole 36, each of the ambient-air pressure port 34 and the ventilation hole 36 can be used as dust-collecting ports for sucking and removing the dust generated in the pressure device 1.

A through hole 37 communicating with the housing chamber is formed in the end cover 5. The pressure rod 20, to the pressure end 20*b* of which an attachment 38 is attached and to the base end 20*a* of which the reciprocating body 12 is attached, is reciprocably inserted in the through hole 37. In a conventional commonly used fluid pressure cylinder, a sealing member such as a packing is used in the through hole into which the pressure rod is inserted. However, in the pressure device 1, no sealing member is attached to the through hole 37. The through hole 37 communicates with the ambient-air pressure chamber 33 which does not require ensuring airtightness, and no sliding friction is generated between the through hole and the reciprocating pressure rod 20.

Therefore, when the pressure device 1 is disposed so that the pressure end 20*a* of the pressure rod 20 is directed vertically downwardly, a gap with a predetermined distance is formed between the pressure rod 20 and the through hole 37, so that the pressure rod 20 does not come into contact with the through hole 37 and generates no sliding friction when the pressure rod 20 reciprocates. At this time, if the weight offset pressure chamber 29 is filled with the predetermined fluid pressure P2, vertically upward weight offset thrusts against the self weight of the reciprocating body 12 and the pressure rod 20 are applied to the reciprocating body 12, so that the reciprocating body 12 can be maintained in a state of being out of contact with any of inner wall surfaces of the cylinder body 6. When the reciprocating body 12 is caused to be in such a floating state, the predetermined pressure thrust can be applied to an object to be pressurized W by supplying the predetermined fluid pressure P1 to the advance pressure chamber 27 and by eliminating influences of the gravity working on the reciprocating body 12 and the pressure rod 20. If the reciprocating body 12 is in the floating state, a vertical-directional error between the pressure device 1 and the object to be pressurized W, e.g., variation in the thickness of the object to be pressurized W is permissible.

Figure 3A:
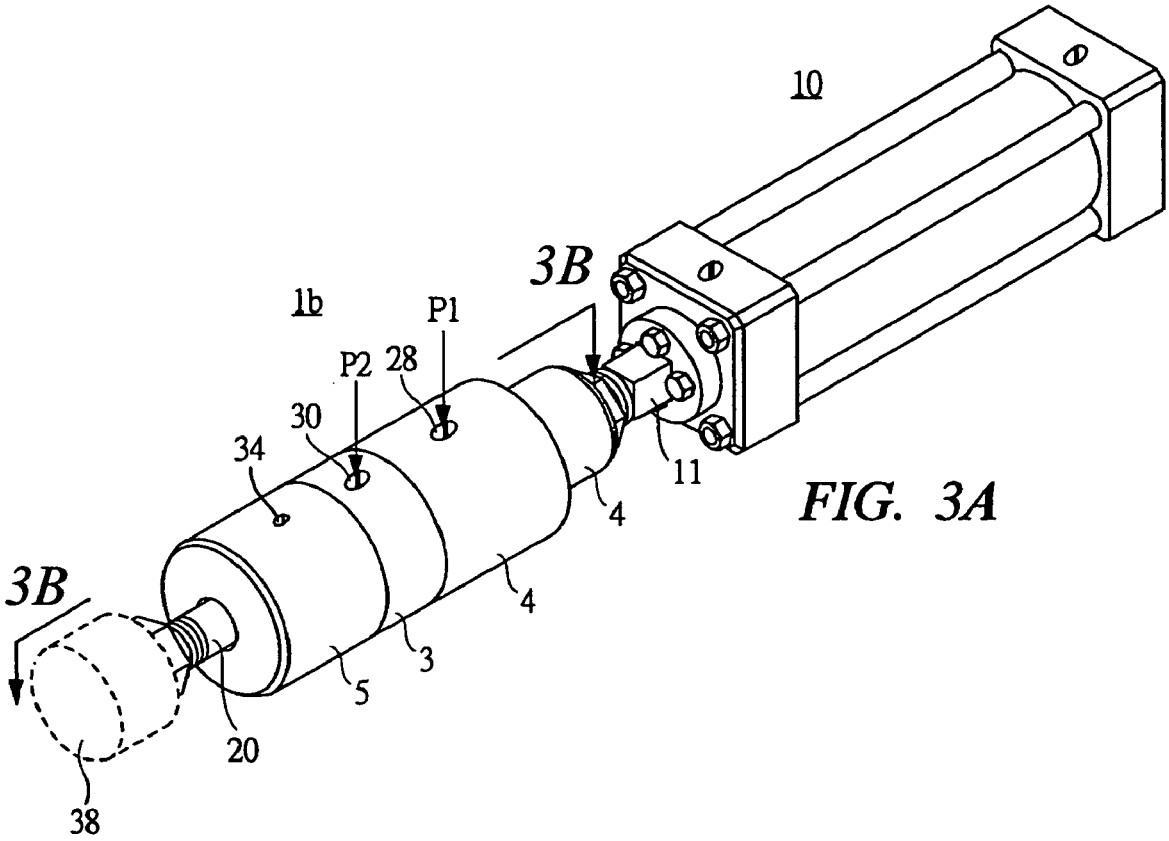
FIG. 3A is a perspective view showing a state in which a pressure device which is another embodiment of the present invention is attached to the fluid pressure cylinder.
Figure 3B:
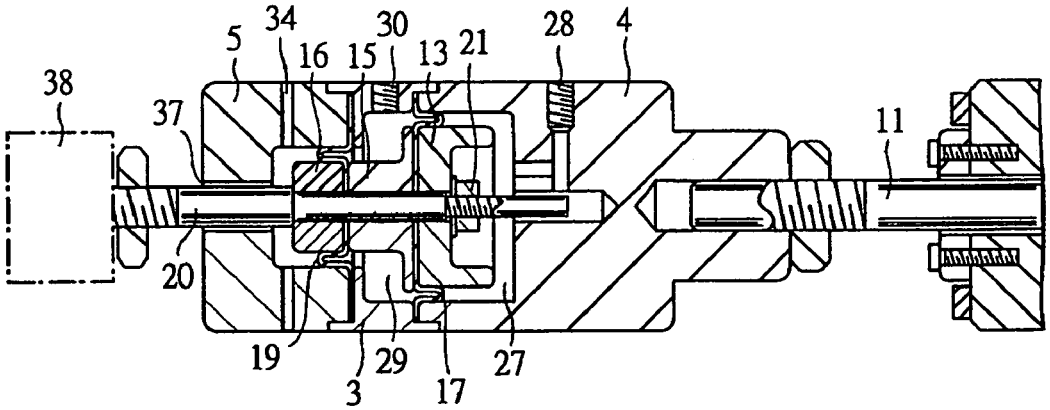
FIG. 3B is a vertical cross-sectional view in a direction along the line 3B-3B in FIG. 3A.

When the pressure thrust against the object to be pressurized W is set small, installation of the weight offset pressure diaphragm 18 can be omitted. FIG. 3A is a perspective view showing a state in which a pressure device which is another embodiment of the present invention is attached to the fluid pressure cylinder, and FIG. 3B is a vertical cross-sectional view in a direction along the line 3B-3B in FIG. 3A. Note that members in common with the members in the above-described embodiment are denoted by the same reference numerals.

When the pressure thrust toward the object to be pressurized W, i.e., the fluid pressure P1 supplied to the advance pressure chamber 27 is set small, the folded portion of the advance pressure diaphragm 17 is not reversed by counter pressure acted thereon. Therefore, by omitting the weight offset pressure diaphragm 18 and by disposing the folded portion of the advance pressure diaphragm 17 toward the side of the advance pressure chamber 27 in which supplied pressure is relatively low, the number of parts can be reduced without impairing the effects of the present invention. The formation of the ventilation hole 36 is also not required, which results in reduction of processing costs. Note that as a modification example of the shape of the advance pressure-receiving member 13, as shown in FIG. 3B, a central portion of the advance pressure-receiving member 13 may be processed to be a concave shape so that the nut 21 is housed therein.

Figure 4A:
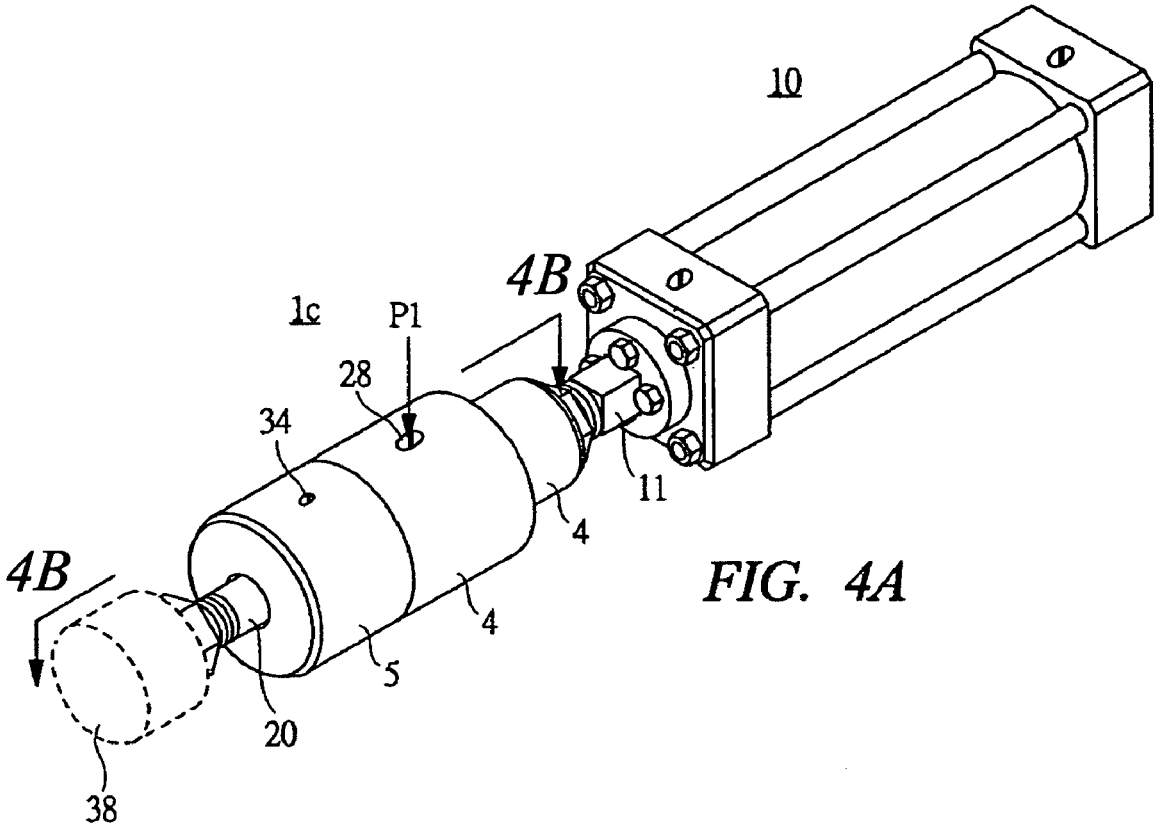
FIG. 4A is a perspective view showing a state in which a pressure device which is further another embodiment of the present invention is attached to the fluid pressure cylinder.
Figure 4B:
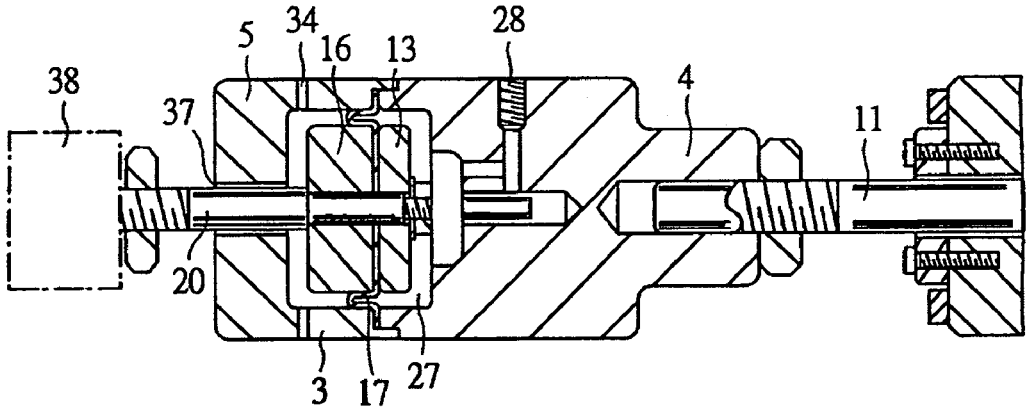
FIG. 4B is a vertical cross-sectional view in a direction along the line 4B-4B in FIG. 4A.

The pressure device 1 can be horizontally disposed and used. In this case, provision of the weight offset pressure chamber 29 is not required. FIG. 4A is a perspective view showing a state in which a pressure device which is further another embodiment of the present invention is attached to the fluid pressure cylinder, and FIG. 4B is a vertical cross-sectional view in a direction along the line 4B-4B in FIG. 4A. Note that members in common with the members in the above-described embodiments are denoted by the same reference numerals.

When pressure is horizontally applied to the object to be pressurized W, the pressure device 1*c* is also disposed horizontally and the self weight of the reciprocating body 12 and the pressure rod 20 does not directly affect the pressure thrust. Therefore, the respective members, i.e., the rod collar 14, the weight offset pressure-receiving member 15, the weight offset pressure diaphragm 18, and the offset load adjusting diaphragm 19, which constitute the weight offset pressure chamber 29, are omitted, whereby the reduction of the number of parts can be achieved. Forming the weight offset supply/discharge port 30 and the ventilation hole 36 is not required, which results in the reduction of the processing costs.

By use of the pressure device 1, the pressure thrust can be caused to act on the object to be pressurized W with high accuracy, so that, for example, it can be used for applying the constant pressure to a squeegee head in screen printing. In screen printing, a rubber squeegee is used to press ink through a mesh such as a silk screen, a paint screen, or a stencil screen onto paper or cloth. However, the pressure devices 1, 1*b*, and 1*c* of the present invention can be used for driving the squeegee. In addition, the present invention can be applied to any cases as long as an object is moved by a predetermined stroke and thereafter a constant pressure thrust is applied to the object similarly to, for example, a chip mounter for mounting semiconductor chips on a mounting board or to a tension roller of a coiling device.

Figure 5:
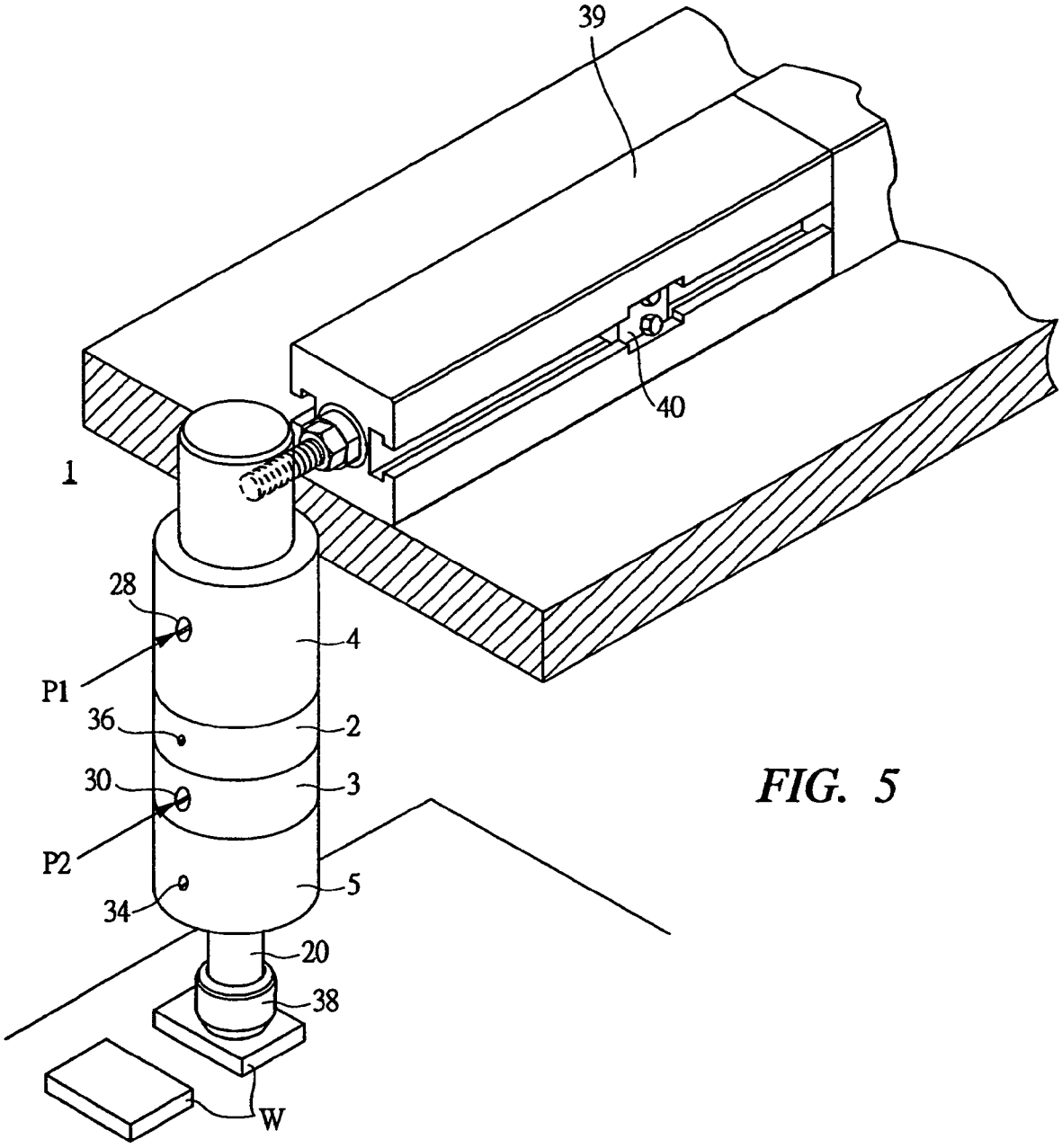
FIG. 5 is a perspective view showing a pressure device which is further another embodiment of the present invention.

Needless to say, the present invention is not limited to the above-mentioned embodiments and can be variously modified within the scope of not departing from the gist thereof. For example, in the above-described embodiments, the reciprocating body 12 is driven by the compressed air. However, hydraulic pressure may be used as a driving medium. As shown in FIG. 5, the pressure device 1 may be attached to an electric actuator 39, and its attaching position is not limited to that in the case of being linearly connected. The piston rod of the actuator may be attached to a circumferential side surface of the pressure device 1. A position detection sensor 40 may be incorporated for accurately conveying the pressure device 1 to a predetermined position.

INDUSTRIAL APPLICABILITY

This pressure device can be used to apply constant pressure to the squeegee head in screen printing. Also, the pressure device can be utilized in the chip mounter for mounting the semiconductor chips on the mounting board and in the tension roller of the coiling device, by replacing the attachment attached to the pressure end of the pressure rod.

The invention claimed is:

1. A pressure device attached to an actuator and applying: pressure to an object to be pressurized, the device comprising:

a cylinder body, to one end of which an attachment of said actuator is attached and at the other end of which an insertion hole communicating with a housing chamber formed therein is provided;

a pressure rod axially reciprocably attached to said cylinder body and provided, at one end of the pressure rod, with a pressure end protruding from said insertion hole;

a reciprocating body provided at the other end of said pressure rod and having a diameter smaller than that of an inner circumferential surface of said housing chamber, which is reciprocably housed in said housing chamber;

an advance pressure diaphragm provided between said reciprocating body and said cylinder body and partitioning and forming an advance pressure chamber for applying a pressure thrust toward said object to be pressurized;

a weight offset pressure diaphragm provided between said reciprocating body and said cylinder body and partitioning and forming a weight offset pressure chamber for applying a weight offset thrust in a direction opposite to said pressure thrust; and an offset adjusting diaphragm provided between said reciprocating body and said cylinder body, partitioning and forming said weight offset pressure chamber along with said weight offset pressure diaphram, and blocking off the weight offset pressure chamber and an ambient-air pressure chamber.

2. The pressure device according to claim 1, wherein said reciprocating body and said pressure rod are disposed so that said pressure rod is directed vertically downwardly, and said weight offset pressure chamber is filled with compressed fluid that is set at fluid pressure capable of retaining said reciprocating body in a state in which said reciprocating body is out of contact with any of inner wall surfaces of said cylinder body.

3. The pressure device according to claim 1, wherein a dust collecting port is formed in said cylinder body.

4. The pressure device according to claim 1, comprising a gap between an outer circumferential surface of said pressure rod and an inner circumferential surface of said insertion hole.

5. The pressure device according to claim 1, wherein a ventilation hole is formed in said cylinder body.

6. The pressure device attached to an actuator and applying pressure to an object to be pressurized, the device comprising:

a cylinder body, to one end of which an attachment of said actuator is attached and to the other end of which an insertion hole communicating with a housing chamber formed therein is provided;

a pressure rod axially reciprocably attached to said cylinder body and provided, at one end of the pressure rod, with a pressure end protruding from said insertion hole;

a reciprocating body provided at the other end of said pressure rod and having a diameter smaller than that of inner circumferential surface of said housing chamber, which is reciprocably housed in said housing chamber;

an advance pressure rolling diaphragm provided between said reciprocating body and said cylinder body and partitioning and forming an advance pressure chamber for applying a pressure thrust toward said object to be pressurized;

a weight offset pressure rolling diaphragm provided between said reciprocating body and said cylinder body and partitioning and forming a wieght offset pressure chamber for applying a weight offset thrust in a direction opposite to said pressure thrust; and an offset load adjusting rolling diaphragm provided between said reciprocating body and said cylinder body, partitioning and forming said weight offset pressure chamber along with said weight offset pressure rolling diaphragm, and blocking off the weight offset pressure chamber and an ambient-air pressure chamber.

* * * * *

UNITED STATES PATENT AND TRADEMARK OFFICE

CERTIFICATE OF CORRECTION

PATENT NO. : 7,464,544 B2
APPLICATION NO. : 10/552404
DATED : December 16, 2008
INVENTOR(S) : Kazutoshi Kono et al.

It is certified that error appears in the above-identified patent and that said Letters Patent is hereby corrected as shown below:

Column 9, line 9, please insert --load-- after the word “offset”.
Column 10, line 1, please delete the word “The” and insert the word --A--.
Column 10, line 21, please delete the word “wieght” and insert the word --weight--.

Signed and Sealed this

Third Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,464,544 B2
APPLICATION NO. : 10/552404
DATED : December 16, 2008
INVENTOR(S) : Kazutoshi Kono et al.

It is certified that error appears in the above-identified patent and that said Letters Patent is hereby corrected as shown below:

On the Title Page, Item [73]: After Assignee: Koganei Corporation, Tokyo (JP), please insert --and Yugenkaisha Ariizumi Sekkei, Tokyo (JP)--.

Signed and Sealed this

Tenth Day of November, 2009

David J. Kappos

David J. Kappos
*Director of the United States Patent and Trademark Office*